US006802462B2

(12) United States Patent
Gransow et al.

(10) Patent No.: US 6,802,462 B2
(45) Date of Patent: Oct. 12, 2004

(54) MULTIPOSITION HAND SHOWER

(75) Inventors: Eckhard Gransow, Fröndenberg (DE); Hans Lobermeier, Menden (DE); Bernd Bischoff, Hemer (DE); Hans-Peter Strelow, Freiburg (DE); Sascha Körfer, Hemer (DE); Holger Ellerbrock, Unna (DE); Andreas Kirchhoff, Wickede (DE); Thomas Raadts, Fröndenburg (DE); Joachim Störk, Kippenheimg (DE); Hans-Jürgen Linde, Coburg (DE); Uwe Neumann, Bamberg (DE); Andreas Rehklau, Coburg (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/991,465

(22) Filed: Nov. 16, 2001

(65) Prior Publication Data

US 2002/0074430 A1 Jun. 20, 2002

(30) Foreign Application Priority Data

Dec. 20, 2000 (DE) ..... 100 63 956

(51) Int. Cl.[7] ..... A62C 31/02

(52) U.S. Cl. ..... 239/392; 239/436

(58) Field of Search ..... 239/390–394, 239/397, 436, 587.5, 587.6, 587.1, 269, 443–449

(56) References Cited

U.S. PATENT DOCUMENTS 2,144,644 A * 1/1939 Ward ..... 239/587.6
3,779,467 A * 12/1973 Arbon ..... 239/538
6,257,505 B1 * 7/2001 Wang ..... 239/526

FOREIGN PATENT DOCUMENTS

DE 22 46 520 5/1973

* cited by examiner

*Primary Examiner*—Christopher Kim
(74) *Attorney, Agent, or Firm*—Herbert Dubno Andrew Wilford

(57) ABSTRACT

A hand shower has a handle having an outer part extending along a handle axis and having an outer face and a shower head forming at least one spray opening directed along a spray axis extending nonparallel to the handle axis. A pivot between the handle and shower head allows pivoting of the head on the handle about a pivot axis inclined at 30° to 90° to the handle axis, normally 45°. The pivot axis extends at an angle between 35° and 50° to the spray axis.

14 Claims, 2 Drawing Sheets

MULTIPOSITION HAND SHOWER

FIELD OF THE INVENTION

The present invention relates to a hand shower. More particularly this invention concerns such a hand shower whose spray head can be set at different angles with respect to its handle.

BACKGROUND OF THE INVENTION

A standard hand shower has a head from which a spray is emitted in a direction normally generally perpendicular to an axis of the handle of the shower. This handle is held in the hand and the user directs the spray at the body parts to be washed or rinsed. Such a system is convenient for bathing, but is somewhat more difficult to use for shampooing the hair, washing down the shower walls, or spraying some parts of the user. If, for example, the user cares to direct a spray at the lower back to ease back pain the standard hand shower is extremely difficult and uncomfortable to use.

Thus it is known to provide a wall mount so that the shower can be fixed on the wall at one or more levels. Such an arrangement makes shampooing easy, but still does not allow, for instance, a horizontal spray to be emitted for spraying a back or leg for spray massage. Furthermore directing the spray upward to wash down the shower walls is particularly difficult.

German patent document 2,246,520 of Argon describes a shower having a head whose spray is directed at about 45° to an axis of the body, and the head is pivotal about the body axis so that the spray can be pointed in various directions relative to the handle body. While this arrangement is somewhat more convenient than the fixed-angle sprayers, it still does not allow, for instance, a spray to be emitted parallel or perpendicular to the body axis, and otherwise cannot assume certain positions.

OBJECTS OF THE INVENTION

It is therefore an object of the present invention to provide an improved hand shower.

Another object is the provision of such an improved hand shower which overcomes the above-given disadvantages, that is which can assume virtually any desired position, even directing a spray horizontally or straight up if needed.

A further object is to provide such a sprayer that can be used with a conventional wall-mount rod to provide a wide range of different spray positions.

SUMMARY OF THE INVENTION

A hand shower has a handle having an outer part extending along a handle axis and having an outer face and a shower head forming at least one spray opening directed along a spray axis extending nonparallel to the handle axis. According to the invention a pivot between the handle and shower head allows pivoting of the head on the handle about a pivot axis inclined at 30° to 90° to the handle axis, normally 45°.

With the system of this invention the spray emitted by the head can be directed at virtually any angle relative to the handle. Thus in a wall-mount system the hand shower can be set to spray downward, horizontally, or even upward. When used by hand the ability to point the spray in virtually any direction relative to the handle is particularly convenient, for instance, when the device is used to wash the shower walls it can be pointed upward easily.

The pivot axis in accordance with the invention extends at an angle between 35° and 50° to the spray axis. This orientation further increases the versatility of the hand shower according to the invention. The handle according to the invention is actuate and has an inner part generally perpendicular to the pivot axis.

The head is substantially part spherical and has an outer circular rim and an inner circular rim and comprises a generally flat spray plate secured to the outer rim. The inner rim rides on the outer end of the handle. The rims lie in respective planes forming an acute angle with each other. The plane of the inner rim extends perpendicular to the pivot axis.

The head in accordance with the invention forms a pair of separate compartments and is formed with an array of spray holes opening to the exterior from one of the compartments and at least one different spray hole opening to the exterior from the other of the compartments. The array of spray holes forms a multi jet spray and the one different spray hole forms a curtain spray. In addition the head is formed offset from the pivot axis with a thoroughgoing feed hole opening into the one compartment and, at a different spacing from the axis, with another through-going feed hole opening into the other compartment. The handle is formed centered on the pivot axis with a pair of annular distribution passages respectively communicating with the feed holes. A valve in the handle feeds pressurized water alternately to the passages. This valve is provided with a spring biasing it into a position feeding the pressurized water to the one compartment. It is movable into another position feeding the pressurized water to the other compartment and is constructed such that, when in the other position and when the valve is pressurized, the valve stays in the other position. Alternately a flow-control valve could be provided in the handle.

The handle according to the invention includes a core body on which the head is pivoted and which has an inner end adapted for connection to a supply hose, and a shell surrounding the core body and having formations snap fitted thereto.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
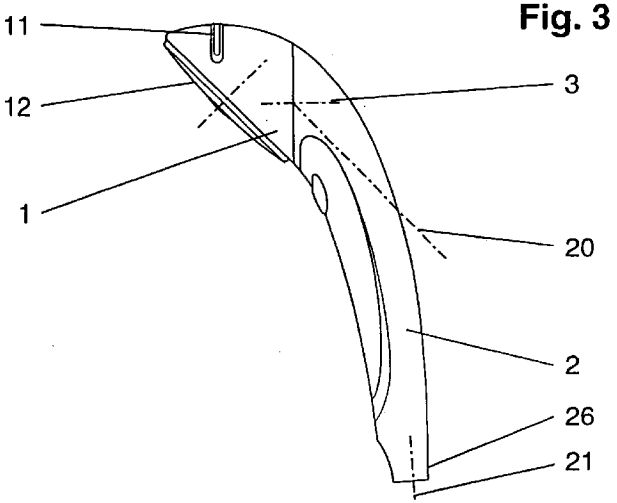
FIG. 3 is a view like FIG. 1 of another shower in accordance with the invention.
Figure 4:
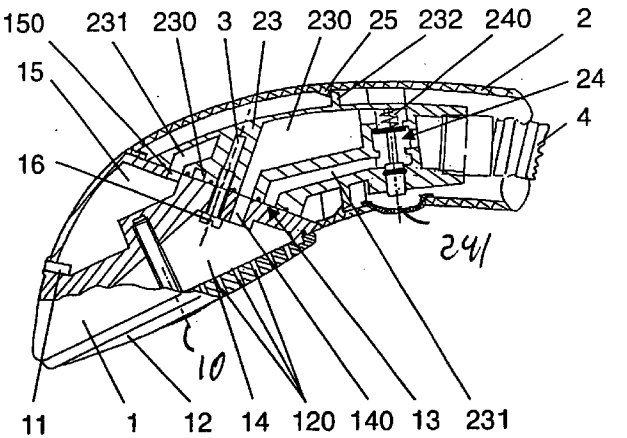
FIG. 4 is a larger-scale section through the outer portion of the shower of FIG. 3 set for curtain spray.
Figure 1:
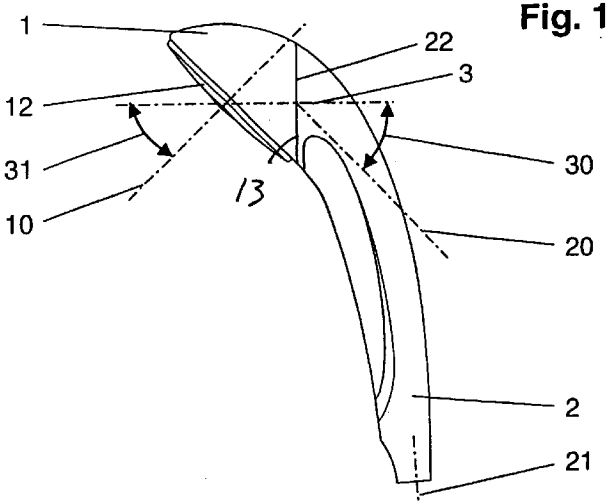
FIGS. 1 and 2 are side views of a shower according to the invention in to different positions.
Figure 2:
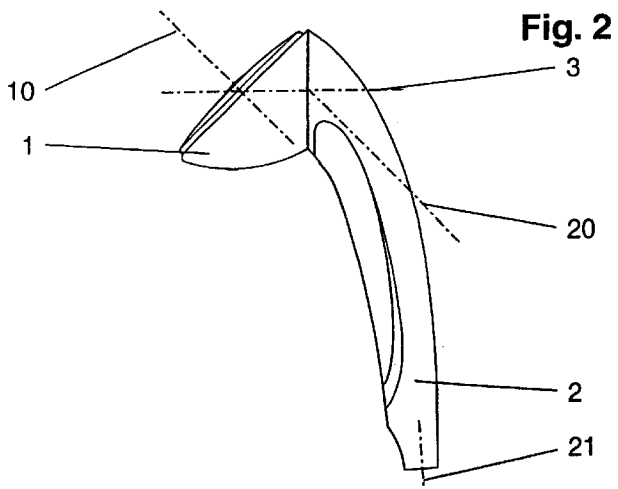

As seen in FIGS. 1 and 2 a hand shower according to the invention has a head 1 and a handle 2, the latter being actuate and having an outer part extending along an axis 20 and an inner part extending along an axis 21 forming a small acute angle with the axis 20. The head 1 has a flat inner rim or face 22 that can pivot on a flat outer face or rim 13 of the handle 2 about an axis 3 forming an angle 30 of about 45° to the axis 20, the two faces 13 and 22 extending perpendicular to the axis 3. The head 1 further has a generally flat spray plate 12 formed with openings (120 in FIG. 4) that are directed generally parallel to an axis 10 forming an angle 31 of about 45° to the axis 3. Thus as shown in FIG. 1 in a normal position, which is the position most fixed-angle hand showers use, the spray parallel to the axis 10 is directed roughly perpendicular to the axis 20 of the outer end of the handle 2. When, however, the head 1 is pivoted through 180° about the axis 3 as shown in FIG. 2, the spray axis 10 is directed parallel to the handle axis 20.

FIGS. 3 through 6 show a variation on this system, where identical reference numerals are used for functionally identical structure. Here the handle 2 has a core body 23 into which is fitted one end of a supply hose 4 and on which two shell parts are snap fitted by engagement of formations or barbs 25 with an annular and outwardly directed rib 232 on the core body 23.

The head 1 is secured via a bolt 16 at the axis 3 to the body 23 and has a pair of compartments 14 and 15. The compartment 14 communicates via a hole 140 with an annular distributing passage 230 in the body 23 and via the spray holes 120 with the exterior, these holes 120 being directed parallel to the axis 10. The compartment 15 communicates via a hole 150 with an annular distributing passage 231 on the body 23 and via a slot 11 with the exterior, this slot 11 opening roughly perpendicular to the axis 3 and at about 45° to the axis 10. The distributor passages 230 and 231 are annular, of different diameters, and centered on the axis 3 so that in all angular positions of the head 1 they communicate with the respective holes 140 and 150.

A valve 24 in the body 23 can direct water from the supply conduit 4 to either the passage 230 or 231. A spring 240 normally urges the valve 24 into a position diverting flow to the distributing passage 230 and thence through the hole 140 into the compartment 14 to form a multi jet spray emitting from the holes 120 parallel to the axis 10. This is the normal spray position. When a membrane 241 is pressed, the valve 24 diverts flow to the distributing passage 231 and thence through the hole 150 into the compartment 15 to form a single curtain spray emitting from the slot 11 perpendicular to the axis 3. In this latter position water pressure will hold the spring 240 compressed so that, once the valve 24 is actuated, it will stay in the curtain-spray position until pressure is relieved and the spring 240 can return it to the normal multi jet-spray position.

Figure 7:
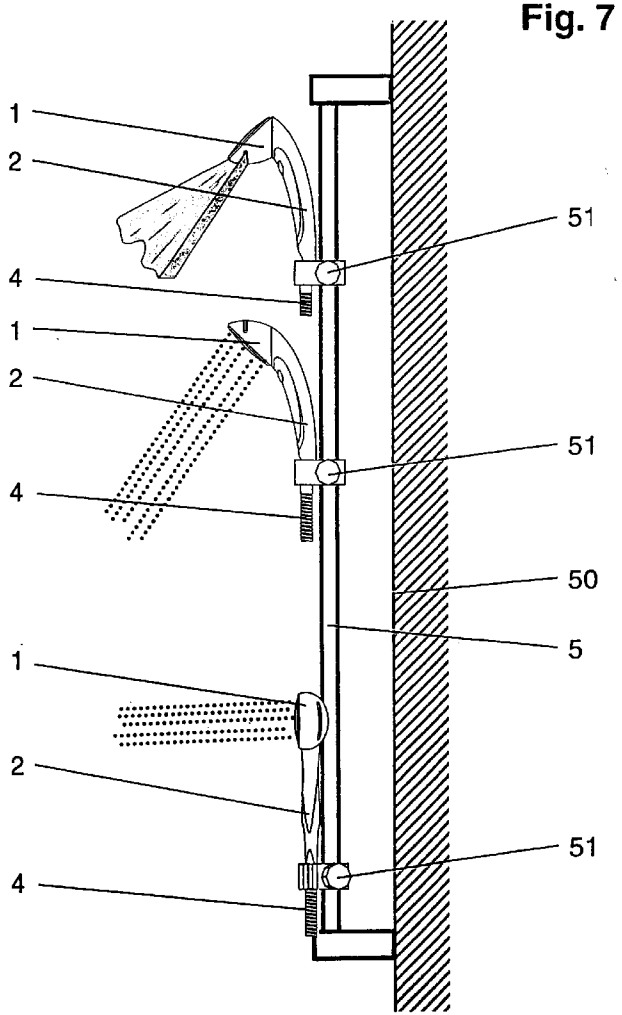
FIG. 7 is a small-scale side view illustrating use of the shower of FIG. 3 in three different positions.
Figure 5:
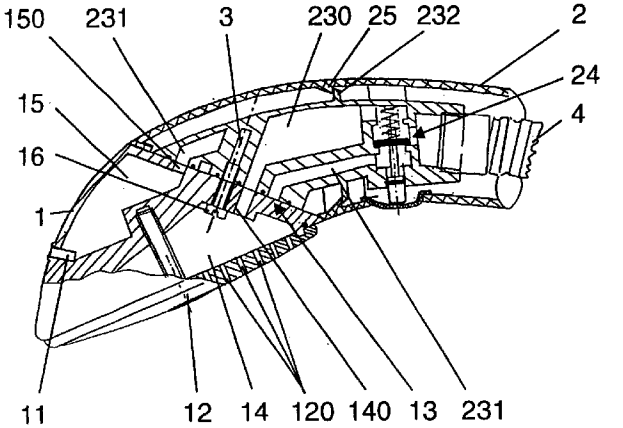
FIG. 5 is a view like FIG. 4 but set for normal spray.
Figure 6:
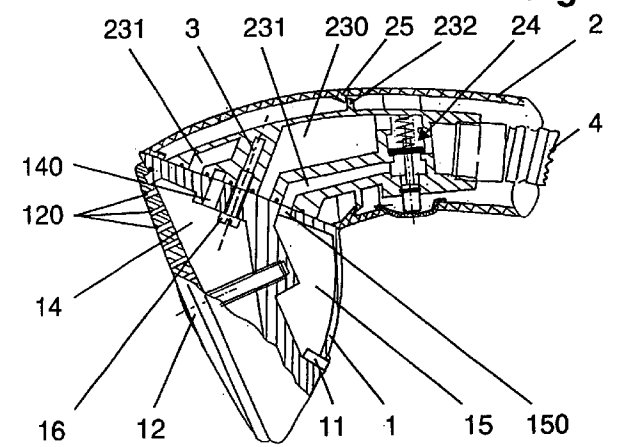
FIG. 6 is a view like FIG. 5 but with the shower head twisted through 180° as in FIG. 2.

FIG. 7 shows how a lower end 26 of the handle 2 can be fitted to a holder 51 carried on a vertical rod 5 mounted on a wall 50. In the lowermost position the spray is emitted from the holes 120 virtually horizontally. In the middle position the spray is directed downward at an angle of about 45°. In the upper position valve 24 is actuated and the head 1 is turned around through 180° relative to the middle position to direct a curtain spray downward at about 45°. Of course all intermediate positions are also-possible.

We claim:

1. A hand shower comprising:

an arcuate handle having an outer part extending along a handle axis and having an outer face and an inner part;

a shower head forming at least one spray opening extending parallel to a spray axis; and pivot means between the handle and shower head for pivoting the head on the handle about a pivot axis inclined at 30° to 90° to the handle axis, generally perpendicular to the handle inner part, and extending nonparallel to the spray axis.

2. The hand shower defined in claim 1 wherein the pivot axis extends at 45° to the handle axis.

3. The hand shower defined in claim 1 wherein the pivot axis extends at an angle between 35° and 50° to the spray axis.

4. The hand shower defined in claim 1 wherein the head is substantially part spherical and has an outer circular rim and an inner circular rim and comprises a generally flat spray plate secured to the outer rim, the inner rim riding on the outer end of the handle.

5. The hand shower defined in claim 4 wherein the rims lie in respective planes forming an acute angle with each other, the plane of the inner rim extending perpendicular to the pivot axis.

6. A hand shower comprising:

a handle having an outer part extending along a handle axis and having an outer face;

a shower head forming a pair of separate compartments and formed with an array of spray holes opening to the exterior, extending parallel to a spray axis, and communicating with one of the compartments and with another spray hole opening to the exterior and communicating with the other of the compartments; and pivot means between the handle and shower head for pivoting the head on the handle about a pivot axis inclined at 30° to 90° to the handle axis and extending nonparallel to the spray axis.

7. The hand shower defined in claim 6 wherein the array of spray holes form a multi jet spray and the other hole forms a curtain spray.

8. The hand shower defined in claim 6 wherein the head is formed offset from the pivot axis with a thoroughgoing feed hole opening into the one compartment and, at a different spacing from the pivot axis, with another thoroughgoing feed hole opening into the other compartment, the handle being formed centered on the pivot axis with a pair of annular distribution passages respectively communicating with the feed holes.

9. The hand shower defined in claim 8, further comprising valve means in the handle for feeding pressurized water alternately to the passages.

10. The hand shower defined in claim 9 wherein the valve means is provided with a spring biasing it into a position feeding the pressurized water to the one compartment.

11. The hand shower defined in claim 10 wherein the valve means is movable into another position feeding the pressurized water to the other compartment and is constructed such that, when in the other position and when the valve is pressurized, the valve stays in the other position.

12. The hand shower defined in claim 6 wherein the handle is actuate and has an inner part generally perpendicular to the pivot axis.

13. A hand shower comprising:

a handle having a core body having an inner part adapted for connection to a supply hose and an outer part extending along a handle axis and having an outer face, and a shell surrounding the core body and having formations snap fitted thereto;

a shower head pivoted on the outer face and forming at least one spray opening extending parallel to a spray axis; and pivot means between the handle and shower head for pivoting the head on the handle about a pivot axis inclined at 30° to 90° to the handle axis and extending nonparallel to the spray axis.

14. The hand shower defined in claim 13 wherein the handle is actuate and has an inner part generally perpendicular to the pivot axis.

* * * * *